United States Patent [19]

Roeder

[11] Patent Number: 4,503,696

[45] Date of Patent: Mar. 12, 1985

[54] METHOD FOR THE PRODUCTION OF SPIKE-FREE SHEETS

[75] Inventor: Gerald M. Roeder, Pittsburgh, Pa.

[73] Assignee: United States Steel Corporation, Pittsburgh, Pa.

[21] Appl. No.: 468,789

[22] Filed: Feb. 22, 1983

[51] Int. Cl.[3] ..... B44C 1/24

[52] U.S. Cl. ..... 72/197; 72/379

[58] Field of Search ..... 72/191, 192, 197, 198, 72/366, 379, 199, 196; 29/121.1, 121.2, 121.4–121.8

[56] References Cited

U.S. PATENT DOCUMENTS

| | | | |
|---|---|---|---|
| 2,277,725 | 3/1942 | Smith et al. | 72/197 |
| 2,377,980 | 6/1945 | Surerus | 72/198 |
| 2,552,364 | 5/1951 | Bradbury | 72/198 |
| 3,839,893 | 10/1974 | Appel et al. | 72/197 |
| 3,956,915 | 5/1976 | Saunders | 72/198 |
| 4,041,750 | 8/1977 | Moore | 72/198 |
| 4,338,807 | 7/1982 | Ricono et al. | 72/187 |

FOREIGN PATENT DOCUMENTS

| | | | |
|---|---|---|---|
| 14973 | 8/1966 | Japan | 72/366 |
| 41751 | 4/1975 | Japan | 72/366 |
| 86601 | 6/1980 | Japan | 72/366 |
| 6702 | 1/1981 | Japan | 72/199 |
| 11704 | 1/1982 | Japan | 72/366 |
| 337114 | 10/1930 | United Kingdom | 72/197 |
| 1334757 | 10/1973 | United Kingdom | 72/366 |
| 1378569 | 12/1974 | United Kingdom | 72/198 |
| 889161 | 12/1981 | U.S.S.R. | 72/199 |

*Primary Examiner*—Lowell A. Larson

*Attorney, Agent, or Firm*—Arthur J. Greif

[57] ABSTRACT

In the production of coined sheet products, particularly sheet steel, rolling pressures sufficient to produce a decorative pattern often result in the formation of undesirable "spikes" on the sheet surface. These "spikes" can require numerous paint coatings for effective coverage. Spikes are eliminated by use of a roll design in which the peaks of the pattern roll are provided with a severely sloping draft angle, the minimum angle for "spike" elimination being a function of the roll diameter, the coined depth of the pattern, the thickness and hardness of the sheet itself and the ratio of the volume of the pattern peaks to the pattern valleys.

7 Claims, 2 Drawing Figures

(PRIOR-ART)

METHOD FOR THE PRODUCTION OF SPIKE-FREE SHEETS

Figure 1:
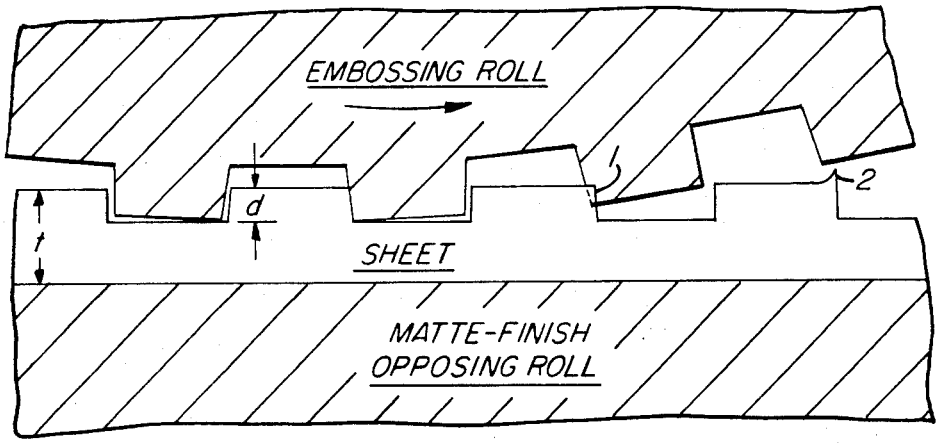

This invention relates to the production of coined sheet products and is particularly related to a procedure for eliminating the "spikes" and other edge defects that result during coining thereof—consequently improving the paintability of the resultant coined sheet surface. Improved "paintability", i.e. more uniform paint coverage, not only provides a more aesthetic appearance with thinner coats of paint, but enhances corrosion resistance, as well.

Architects, decorators, as well as members of the metallurgical industry have long been aware of the decorative possibilities of metallic surfaces. One well known method for achieving such decoration is by masking selected areas of a surface to be decorated and then treating the unprotected portion thereof to alter its appearance such as by etching, polishing or coloring. Such methods, however, have not gained wide commercial application due to the relatively high cost of preparation which is required. Another well known method for achieving decoration is by embossing. In its strictest sense (in relation to the decoration of steel sheet), the term embossing denotes a procedure in which the sheet is passed between a pair of engraved rollers. One roller of the pair, i.e. the male roll, is engraved with the required design. The other roll is engraved with a design opposite or complementary thereto, so that when the sheet is passed between the two rolls, it is provided with a raised ornamental pattern on both planar surfaces of the sheet. A somewhat related procedure known as coining is, in reality, the single side embossing of the sheet, wherein a decorative pattern is coined onto one planar surface of the sheet by passage between a patterned coining roll and a conventional, comparatively smooth surface opposing roll (generally matte-finished) on a temper mill.

Such single-side embossed or coined sheet products have been used in architectural applications, in the automotive industry both for interior trim applications and for the production of a low-cost, textured roof, and in the appliance industry for textured, fingerprint-proof finishes. A problem associated with the production of coined metal sheets is the occurrence of ridges or "spikes" which tend to form along the leading edges in the facets of the sheet. When encountered, these spikes make it difficult to paint the coined metal sheet because the spikes protrude upward through the paint film—thus requiring numerous layers of paint to hide the spikes. A further problem associated with the formation of spikes, during the rolling of the sheet, is the tearing away of the spikes from the sheet material whereby dislodged spikes are thrown into the air as a cloud of metallic particles. These particles are damaging to the mill equipment and have necessitated costly maintenance operations. It was discovered that the ridges or spikes result from the galling action caused by an interference fit between the patterned roll and the sheet, after the patterned roll has formed the coined pattern and begins to disengage from the sheet in the arc of contact. The galling action also increases the energy required to operate the temper mill and increases the wear on the roll. It was discovered that the interference fit resulting in such spikes was determined by an interdependent combination of three primary elements involved in the coining operation; (i) the diameter of the roll, (ii) the depth that the roll is impressed into the sheet material, and (iii) the angle at which the peaks on a patterned roll are sloped with respect to the roll surface.

Figure 2:
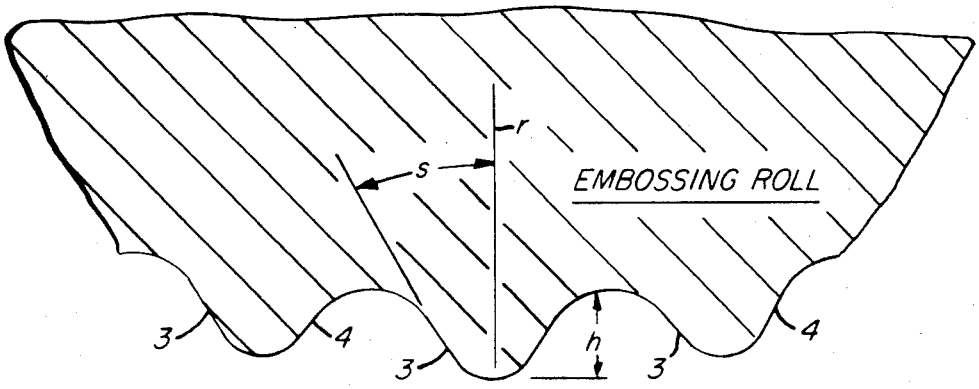

The application of these findings and other advantages of the instant invention will become more apparent from a reading of the following specification when read in conjunction with the appended claims and the drawings in which:

FIG. 1 is a simplified representation of the cross-section of an embossed-roll pattern, showing the interference fit which may result from prior art practice, and FIG. 2 is an analogous representation of an embossed-roll pattern useful in the invention, illustrative of the draft angle necessary to eliminate the tendency for galling of coined sheet steel.

Hardened coining rolls are generally produced by standard photo engraving and acid etching techniques. It is common practice for such coining rolls to be made with diameters ranging from about 10 to 30 inches and with the pattern engraved to a depth of about 0.002 to 0.10 inches. It is also common practice to press the roll deeply enough into the sheet material to achieve depths "d" (see FIG. 1) of the coined pattern from about 0.001 to 0.005 inches. The lower value of impression depth approximates the practical limit necessary to preserve the definition of the coined pattern, while the upper limit approximates the limit of rolling force that can be applied together with the acceptable limit of the plastic extension of the sheet (which is a function of d/t, where "t" is the sheet thickness) material during the coining operation. The depth of the pattern in the embossing roll, in conventional practice, is greater than the depth of the pattern in the sheet, so that the plateau portions of the sheet do not bottom-out in the valley portions of the roll. Pattern depth is controlled by adjustment, both of the roll separations and the front and back tension on the sheet. Apparently, the slope of the peaks or the draft angle (see FIG. 2) in the facets of the pattern engraved on the surface of the coining rolls has generally been ignored.

Referring to FIG. 1, it was discovered that the formation of spikes resulted from an interference fit 1 between the embossing roll and the sheet in the arc of contact after the roll has formed the coined pattern and starts to disengage from the sheet. This interference can result in galling or spiking 2 of the material—a feature which is common to most metals but is generally not encountered in plastics—since the much lower strength plastic does not offer appreciable resistance to the roll's ability to come out of the sheet material. It was further discovered that the tendency for such an interference to occur could be decreased by increasing the diameter of the coining roll, and/or by decreasing the depth that the roll is impressed into the sheet material. However, because of the practical limitation as to roll diameter and impression depth, the formation of spikes must generally be prevented by proper design of the draft angle and the facets of the pattern engraved on the roll. Referring to FIG. 2, the patterns of the embossing rolls are represented (over-simplified) by a series of peaks and valleys, in which the height of the peaks is "h". To decrease the tendency for the formation of an interference fit, the trailing sides 3 of the peaks are provided with a significant slope s, measured between the radius "r" of the respective peak and the side 3. Generally, as a result of the technique (e.g. etching) employed in providing such a slope, the peak will be rounded (no sharp corners) and leading sides 4 thereof will have a similar slope. For a particular pattern, the minimum draft angle which will eliminate an interference fit can be determined by analysis based on the roll diameter; the total elongation of the sheet as a function of pattern depth, "d" and sheet thickness "t" (i.e. d/t); the elastic deformation of the roll in the area of the arc of contact and the geometric characteristics of the pattern. For commercial diameter rolls, i.e. rolls of 10" to 30" in diameter, engraved with common leather-grain patterns, to coin sheet metals with Young's Modulus of 10,000,000 to 30,000,000 psi to a d/t of 0.5 to 0.15, the minimum draft angle will be within the range of 25° to 75°, and generally within the range 35° to 70°. Thus, the draft angle will vary with the above-noted variables, as follows: (a) pattern geometry (on the embossing roll)—where the volume of the pattern cavities is small in comparison with the volume of the peaks, the sheet metal which would normally be forced into the cavity would encounter greater restriction in doing so, causing more extreme sheet extension and a greater tendency to spiking. Conversely, patterns in which the cavities are comparatively large in volume can be sunk more deeply into the steel and thus can tolerate smaller draft angles; (b) sheet material plasticity—the more plastic the material, i.e. the lower the Young's Modulus, the smaller the draft angle. Conversely, materials with a high Young—s Modulus, e.g. steel, tend to resist the ability of the roll to come out of the material, and thereby require comparatively greater draft angles; (c) roll diameter—the interference fit primarily results from the difference in the curvature of the roll and the flat surface of the sheet; thus, flatter roll surfaces, i.e. greater roll diameters, can tolerate smaller draft angles; and (d) depth of embossing (d/t)—the greater the d/t, the greater the elongation; therefore, minimum draft angle will increase with increasing d/t.

In the coining of metal sheet, particularly steel sheet, the hot-rolled coil is cold reduced to final gage, with a reduction in thickness of about 40–70%. The cold reduced sheet is then annealed to substantially recrystallize the structure and the annealed sheet is then coined on a temper mill, using moderately high tension (e.g. about 2% sheet extension) to facilitate penetration of the engraved roll into the softened sheet, thus assuring desired pattern depth. As noted above, it had been the practice, in an attempt to decrease the tendency to form spikes, to control the depth of the pattern in the sheet so that the peak portions of the sheet do not bottom-out in the valley portions of the embossing roll. It was found, however, in using rolls designed in accord with the instant invention, that bottoming of the sheet peaks into the roll's valleys is, in fact, preferable. Thus, even when the teachings of the instant method are employed to eliminate "interference fit" and the resultant spiking, if bottoming out is not employed, there will be a tendency for the sheet peaks to exhibit sharp corners. In attempting to paint such sharp corners (particularly with a paint application thinner than 2 mils) surface tension will cause the paint to pull away from the corners—detracting from the benefits of the instant invention.

In painting coined sheet, particularly with white or other light colors, it was general practice to utilize a total paint thickness (i.e. 2 thin coats or one thick coat) in excess of 2 mils, generally of the order of 3 mils or more—otherwise, non-uniform coverage resulted from the paint being stretched too thin, giving a "blued" appearance. In an evaluation of a production run, it was learned that coined sheet produced by instant method achieved desired "paintability" (including elimination of "blueing") with paint films having a thickness of 1.5 to 2.0 mils.

I claim:

1. In the production of coined metal sheet, in which a coined leather-grain type decorative pattern is produced by the passage of the sheet through opposing rolls having a diameter of 10 to 30 inches, one of said rolls having a pattern thereon the cross-section of which consists of peaks and valleys, said peaks having a height above the valleys of from 0.001 to 0.005 inches, said pattern being a substantial mate of the resultant coined sheet decorative pattern, and the other roll having a comparatively smooth surface, the improvement which comprises producing a coined sheet exhibiting enhanced paintability; wherein the trailing sides of the peaks on said patterned roll are sloped at an angle of 25° to 75° with respect to the respective peak cross-sectional radius and during the passage of the sheet between the opposing rolls, impressing said pattern into the sheet so that the peaks formed thereon will substantially bottom into the valley portions of the patterned roll sufficient to eliminate sharp corners on the sheet peaks; said impression being such that the ratio, d/t, of the height of sheet peaks to sheet thickness is within the range 0.05 to 0.15.

2. The method of claim 1, wherein said metal is steel which has been hot rolled, cold reduced 40 to 70 percent and then annealed to substantially recrystallize the structure.

3. The method of claim 2, in which the comparatively smooth surface of the other roll is a matte-finish surface.

4. The method of claim 3, in which said trailing sides are sloped at an angle of 35 to 70 degrees and said peaks have a height of from 0.002 to 0.004 inches.

5. The method of claim 4, in which said pattern peaks are rounded and the leading sides thereof are sloped at an angle 25° to 75° with respect to the respective peak cross-sectional radius, and said patterned roll is impressed into the sheet so that the sheet peaks so formed bottom-out into the valley portions of the pattern roll.

6. The method of claim 5, in which said ratio, d/t, is within the range 0.05 to 0.1.

7. The method of claim 5, in which said enhanced paintability is evidenced by the absence of "blueing" when said sheet is painted with a white paint film having a thickness of 1.5 mils.

* * * * *

UNITED STATES PATENT AND TRADEMARK OFFICE

CERTIFICATE OF CORRECTION

PATENT NO. : 4,503,696

DATED : March 12, 1985

INVENTOR(S) : Gerald M. Roeder

It is certified that error appears in the above-identified patent and that said Letters Patent is hereby corrected as shown below:

Column 3, lines 27-28, "Youn-g--s Modulus" should be -- Young's Modulus --;

Column 3, lines 49-50, delete the paragraph separation;

Signed and Sealed this

*Third* Day of *September 1985*

[SEAL]

*Attest:*

DONALD J. QUIGG

*Attesting Officer* *Acting Commissioner of Patents and Trademarks - Designate*